US009152098B2

(12) United States Patent
Havens

(10) Patent No.: US 9,152,098 B2
(45) Date of Patent: Oct. 6, 2015

(54) CLEANING APPARATUSES FOR FUSING SYSTEMS

(75) Inventor: Barry R. Havens, Ontario, NY (US)

(73) Assignee: XEROX CORPORATION, Norwalk, CT (US)

( * ) Notice: Subject to any disclaimer, the term of this patent is extended or adjusted under 35 U.S.C. 154(b) by 849 days.

(21) Appl. No.: 13/171,334

(22) Filed: Jun. 28, 2011

(65) Prior Publication Data

US 2013/0004215 A1 Jan. 3, 2013

(51) Int. Cl.
*G03G 15/20* (2006.01)

(52) U.S. Cl.
CPC ..... *G03G 15/2025* (2013.01)

(58) Field of Classification Search
CPC ..... G03G 15/2025; G03G 15/2075; G03G 15/2053; G03G 2215/2035; G03G 2215/2093; G03G 2215/2096
USPC ..... 399/122, 327–332
See application file for complete search history.

(56) References Cited

U.S. PATENT DOCUMENTS 4,663,259 A * 5/1987 Fujimura et al. ..... 430/59.6
5,327,203 A * 7/1994 Rasch et al. ..... 399/326
5,999,786 A 12/1999 Saito
6,041,211 A 3/2000 Hobson et al.
7,580,665 B2 8/2009 Klymachyov et al.
2003/0223790 A1 12/2003 Kawamoto et al.
2005/0031377 A1* 2/2005 Kabata et al. ..... 399/165
2005/0180786 A1* 8/2005 Yamada et al. ..... 399/327
2007/0053729 A1* 3/2007 Yamada et al. ..... 399/327
2008/0038027 A1 2/2008 Ito et al.
2008/0138126 A1* 6/2008 Viney et al. ..... 399/327
2008/0229672 A1* 9/2008 Woo et al. ..... 51/295
2009/0297972 A1* 12/2009 Sakimura et al. ..... 430/66
2009/0304420 A1* 12/2009 Klymachyov et al. ..... 399/327
2010/0111578 A1 5/2010 Derimiggio et al.

OTHER PUBLICATIONS

Search Report and Examination Opinion dated Oct. 1, 2012 issued in Great Britain Patent Application No. 1210832.0, 6 Pages.

* cited by examiner

*Primary Examiner* — Walter L Lindsay, Jr.
*Assistant Examiner* — Jessica L Eley
(74) *Attorney, Agent, or Firm* — MH2 Technology Law Group LLP

(57) ABSTRACT

An embodiment generally relates to a xerographic fusing apparatus including a fuser member; and a cleaning mechanism for the fuser member. The cleaning mechanism can include an abrasive cleaning web in contact with the fuser member, the abrasive cleaning web including a non-woven fabric and at least one abrasive; a supply roll configured to advance the abrasive cleaning web; and a take-up roll configured to collect the abrasive cleaning web.

15 Claims, 3 Drawing Sheets

CLEANING APPARATUSES FOR FUSING SYSTEMS

DETAILED DESCRIPTION

1. Field of Use

This disclosure relates generally to cleaning webs and, more particularly, to cleaning webs for electrophotographic members including xerographic members, such as fuser members and external heating members, and methods of making said cleaning webs.

2. Background

In an electrophotographic printing apparatus, a light image of an original to be copied is recorded in the form of an electrostatic latent image upon a photosensitive member, and the latent image is subsequently rendered visible by the application of electroscopic thermoplastic resin particles and colorant particles ("toner"). The visible toner image, in loose powdered form, can be easily disturbed or destroyed so the toner image is usually thermally fixed or fused upon a support using a fuser member that has been heated by an external heating member. The support can be the photosensitive member itself, or some other support such as plain paper.

Eventually, the fuser member can become contaminated with debris and by-products of toner and paper, such as accumulated toner and gelled fuser oils. This contamination usually appears as a film over the surface of the fuser member and builds up over time, thereby adversely affecting the performance and operating lifetime of the fuser member. Fuser member contamination can cause marks on copy (MOC) problems, contribute to poor image clarity and quality, and adversely affect other apparatus members, all of which eventually leads to early failure of the entire fusing system. Thus, if not properly addressed, fuser contamination can substantially shorten the lifetime utility of expensive fuser members. Similarly, due to their close association with fuser members, external heating members are subject to similar contamination problems. Like fuser member contamination, external heating member contamination reduces the lifetime utility of expensive equipment and increases maintenance costs.

These problems are especially pronounced in tasks involving high area coverage on coated media (e.g., graphic arts) or glossy papers, where contaminated fuser members typically need frequent repair or replacement. Additionally, differential gloss problems can arise when switching to a larger document size after an extended run of a smaller document, as the fuser member surface may have a non-uniform wear pattern due to the smaller document run. Therefore, there is a need to overcome these and other problems of the prior art and to extend fuser and external heating member lifetime utility.

SUMMARY

In accordance with the various embodiments, there is provided a xerographic fusing apparatus including a fuser member; and a cleaning mechanism for the fuser member, the cleaning mechanism including an abrasive cleaning web in contact with the fuser member, the abrasive cleaning web comprising a non-woven fabric and at least one abrasive, the at least one abrasive selected from the group consisting of carbonates, silicates, carbides, clays, and combinations thereof; a supply roll configured to advance the abrasive cleaning web; and a take-up roll configured to collect the abrasive cleaning web.

According to various embodiments, there is provided a xerographic fusing apparatus including an external heating member; and a cleaning mechanism for the external heating member, the cleaning mechanism including an abrasive cleaning web in contact with the fuser member, the abrasive cleaning web comprising a non-woven fabric and at least one abrasive, the at least one abrasive selected from the group consisting of carbonates, silicates, carbides, clays, and combinations thereof; a supply roll configured to advance the abrasive cleaning web; and a take-up roll configured to collect the abrasive cleaning web.

According to various embodiments, there is also provided a method for cleaning a xerographic fusing apparatus, the method including contacting an xerographic member with an abrasive cleaning web comprising polyaramid fibers and at least one abrasive selected from the group consisting of carbonates, silicates, carbides, clays, and combinations thereof; and removing contamination from the xerographic member with the abrasive cleaning web.

Additional advantages of the embodiments will be set forth in part in the description which follows, and in part will be obvious from the description, or may be learned by practice of the disclosure. The advantages will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles of the disclosure.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1:
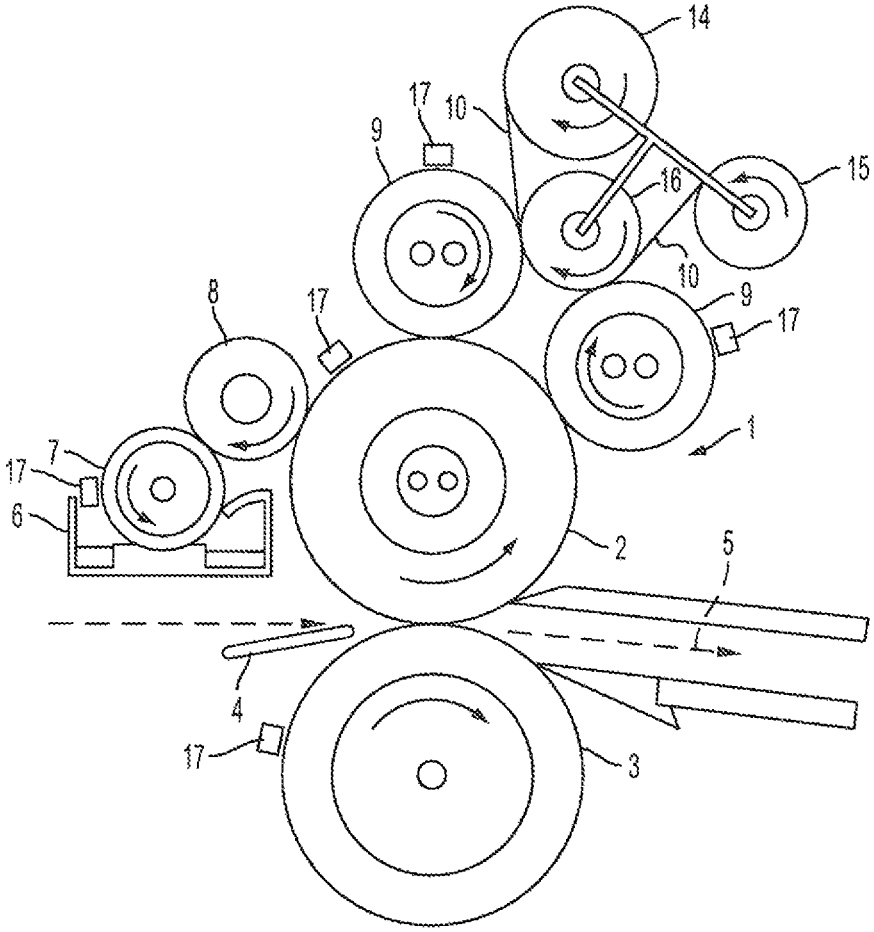
FIG. 1 schematically illustrates an exemplary xerographic fusing apparatus, according to various embodiments of the present teachings.

FIG. 1 schematically illustrates an exemplary xerographic fusing apparatus 1, in accordance with various embodiments of the present teachings. The fusing apparatus 1 is illustrated having a fuser member 2, a pressure member 3 and a paper transport 4 which directs a substrate 5 through a fusing nip between rolls 2 and 3, and a toner image on the substrate can be fused onto the substrate. The arrows on fuser member 2 and pressure member 3 indicate the rotational direction of each member. A release agent reservoir 6 is shown in operative relationship (i.e., the relationship as seen when the apparatus is in operation) to a meter roll 7 and a donor roll 8. In operative contact (i.e., contact that occurs when the apparatus is in operation) with the fuser member 2 are two external heating members 9 (X-rolls) for heating the fuser member 2. The X-rolls 9 are both in operative contact with a cleaning mechanism. The cleaning mechanism can include a cleaning web 10 having an abrasive surface, where the cleaning web 10 contacts roll 16. When in operative contact, the abrasive surface of the cleaning web 10 can "scrub" or clean contamination from the surfaces of the X-rolls 9. Boxes 17 located adjacent to rollers 2, 3, and 9 are thermostats. The cleaning web 10 is supplied from the supply roll 15 and moves to the take-up roll 14 for collection to be later re-used or replaced.

Figure 2:
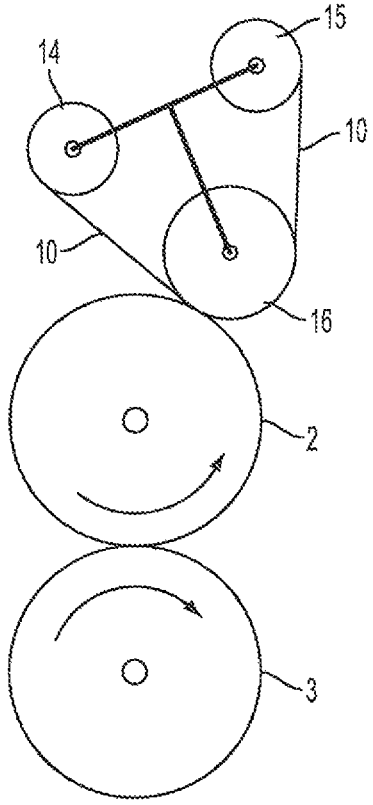
FIG. 2 schematically illustrates a portion of another exemplary xerographic fusing apparatus, according to various embodiments of the present teachings.

FIG. 2 schematically illustrates a portion of another exemplary xerographic fusing apparatus 1, in accordance with various embodiments of the present teachings. In FIG. 2, the fuser member 2 is shown in operative contact with a cleaning mechanism. The cleaning mechanism can include a cleaning web 10 having an abrasive surface. When in operative contact, the abrasive surface of the cleaning web 10 can "scrub" or clean contamination from the surface of the fuser member 2. Otherwise, all of the above discussion relating to FIG. 1 equally applies to FIG. 2.

The fuser member 2 may be in the form of a fuser roll or fuser belt. The fuser member 2 can include a core that is coated with an elastomer layer, such as fluoroelastomers, silicone elastomers, and the like. Commercially available fluoroelastomers can include, for example, VITON® A: copolymers of HFP and VDF (or VF2); VITON® B: terpolymers of TFE, VDF and HFP; VITON® GF: tetrapolymers of TFE, VF2, HFP; as well as VITON® E; VITON® E-60C; VITON® E430; VITON® 910; VITON® GH; and VITON® GF. The VITON® designations are Trademarks of E.I. DuPont de Nemours, Inc. (Wilmington, Del.). Other commercially available fluoroelastomers can include those available from 3M Corporation (St. Paul, Minn.) including, for example, DYNEON™ fluoroelastomers, AFLAS® fluoroelastomers (e.g., a poly(propylene-tetrafluoroethylene)), and FLUOREL® fluoroelastomers (e.g. FLUOREL®II (e.g., LII900) a poly(propylene-tetrafluoroethylenevinylidenefluoride), FLUOREL® 2170, FLUOREL® 2174, FLUOREL® 2176, FLUOREL® 2177, and/or FLUOREL® LVS 76. Additional commercially available fluoroelastomer materials can include the "tecnoflons" identified as FOR®-60KIR, FOR®-LHF, FOR®-NM, FOR®-THF, FOR®-IFS, FOR®-TH, and FOR®-TN505, available from Solvay Solexis (West Deptford, N.J.). The core of the fuser member 2 can be made of any suitable material including, but not limited to, metals such as iron, aluminum, nickel, steel, and the like; and synthetic resins. The core can be hollow and include a heating element positioned inside the hollow core to supply the heat for the fusing operation. Alternatively, the fuser member 2 can be heated by external means, e.g., direct contact with X-rolls 9. In embodiments, the fuser member 2 can be heated by internal means, external means, or a combination of both. Heating means are well known in the art for providing sufficient heat to fuse the toner to the recording substrate 5.

External heating members 9 (X-rolls) provide thermal energy (heat) to the fuser member 2. X-rolls 9 can be a hollow cylinder or a core with hollow cylinders therein, as shown in FIGS. 1 and 2. The cylinder or core can be made from any suitable metal, such as aluminum, anodized aluminum, steel, nickel, copper, and the like. The X-rolls 9 can have a suitable heating element disposed in the hollow portion thereof.

The cleaning web 10 can be a non-woven fabric. The non-woven fabric can include polyaramid fibers. As used herein, the term "non-woven fabric" refers to a bonded sheet or a bonded web formed by entangling fibers or filaments or perforating films together. The bonding in the non-woven fabric can be a mechanical, thermal, and/or chemical bonding. The non-woven fabrics are not made by weaving or knitting and do not require converting the fibers to yarn. The non-woven fabrics can be substantially flat and/or porous. If porous, the non-woven fabric can have a porosity ranging from about 1% to about 99%, such as from about 50% to about 95%, for example from about 60% to about 80%. In embodiments, the porous structures can have an average pore size in a range of from about 50 nm to about 500 μm, for example from about 500 nm to about 50 μm, such as from about 1 μm to about 10 μm.

As used herein, "polyaramid" is understood to have its ordinary meaning as known in the art and refers to a class of strong, heat-resistant synthetic fibers formed from aromatic polyamides. (The term "polyaramid" is a portmanteau of "aromatic polyamide.") Any polyaramid known in the art can be used herein. Exemplary polyaramids include, but are not limited to, para-aramids (aromatic polyamides coupled by para-linkages), meta-aramids (aromatic polyamides coupled by meta-linkages), and combinations thereof. In an aspect, para-aramids can include para-phenylenes with amide groups linked to the phenyl rings at the 1 and 4 positions. A commercially available example of para-aramids is Kevlar®, available from E. I. du Pont de Nemours and Company of Wilmington, Del. In another aspect, meta-aramids can include meta-phenylenes with amide groups linked to the phenyl rings at the 1 and 3 positions. A commercially available example of meta-aramids is Nomex®, available from E. I. du Pont de Nemours and Company of Wilmington, Del. The non-woven fabric can also include other heat-resistant polymers in addition to polyaramid fibers. In embodiments, the polyaramid fibers can be present in the non-woven fabric in an amount ranging from about 0 wt. % to about 100 wt. %, for example from about 50 wt. % to about 95 wt. % or about 75 wt. % to about 90 wt. %. In embodiments, the non-woven fabric can have a specific gravity ranging from about 0.4 $g/cm^3$ to about 1.2 $g/cm^3$, for example from about 0.4 $g/cm^3$ to about 0.8 $g/cm^3$, such as from about 0.5 $g/cm^3$ to about 0.7 $g/cm^3$. In an aspect, the non-woven fabric can have a specific gravity of about 0.6 $g/cm^3$.

The non-woven fabric can have an abrasive 20 disposed over a surface to form a cleaning web 10. As used herein, an "abrasive cleaning web" is understood to mean a non-woven fabric including an abrasive disposed over a surface. Any abrasive can be used, though the type of abrasive typically depends on the fusing system. Any amount of the abrasive can be used to provide the desired amount of abrasion so long as the abrasive does not prematurely wear the fuser member, external heating member, or other fuser components; or interfere with the application of fuser fluid.

Exemplary abrasives 20 can include, but is not limited to, carbonates, carbides, silicates, clays, and combinations thereof. In embodiments, the abrasive 20 can include calcium carbonate, silicon carbide, silicates, and combinations thereof. An aqueous or solvent-based solution or slurry including the abrasive 20 can be applied by any method known in the art to a surface of the non-woven fabric. The water or solvent can be evaporated so the abrasive 20 remains on the surface of the non-woven fabric to form the abrasive cleaning web. The abrasive 20 can also be applied to the non-woven fabric in dry form by any method known in the art, for example by sprinkling the abrasive 20 onto the surface of the non-woven fabric as it is being wound into a roll to yield a cleaning web 10 having abrasive 20 that physically interacts with the non-woven fabric. The abrasive 20 can further be applied to the non-woven fabric with an oil-based slurry (e.g., a slurry of fuser oil) including the abrasive 20. The oil-based slurry including the abrasive 20 can be applied by any method known in the art to a surface of the non-woven fabric to form a cleaning web 10.

In aspects, the abrasive 20 can physically interact with the cleaning web 10. As used herein, "physically interact" is understood to mean the abrasive is in physical contact with the cleaning web 10 but is not chemically bonded to the cleaning web 10. In embodiments, the abrasive can physically interact with the non-woven fabric and, when the cleaning web 10 contacts another member, such as an X-roll 9, the abrasive can be transferred from the cleaning web 10 to the X-roll 9. From there, the abrasive can be transferred to the fusing nip between rolls 2 and 3 to promote scrubbing of the fuser member 2.

In an aspect, the aqueous or solvent-based solution or slurry can include the abrasive 20 and a heat-resistant organic or inorganic binder to bond the abrasive 20 to the non-woven fabric surface. Exemplary heat-resistant binders include, but are not limited to, high temperature binders such as colloidal silica, organic titanates and zirconates, inorganic silicates, polyimides, phenolic resins, silicone resins, silicone containing blends/copolymers, fluoropolymers, and the like, and combinations thereof. Suitable heat-resistant binders are described in the article, "High heat resistant coating systems" by Phil Phillips (www.coatingsworld.com), April 2009, the disclosure of which is hereby incorporated by reference in its entirety. After application, the water or solvent in the solution or slurry can be evaporated so the abrasive 20 remains bonded to the surface of the non-woven fabric by the binder to form the abrasive cleaning web 10. In embodiments, when the cleaning web 10 contacts another member, such as an X-roll 9, the abrasive can remain on the cleaning web 10 while rejuvenating the surface of the external heat roll by scrubbing contaminants and the like from the X-roll surface. In other embodiments, some of the abrasive 20 can remain on the cleaning web 10 to clean the X-roll 9, while some of the abrasive 20 can be transferred to the fusing nip between rolls 2 and 3 to promote scrubbing of the fuser member 2. In embodiments, the binder can be present in the solution or slurry in an amount ranging from about 1% to about 95%, for example from about 5% to about 60%, such as from about 10% to about 20%.

Figure 3A:
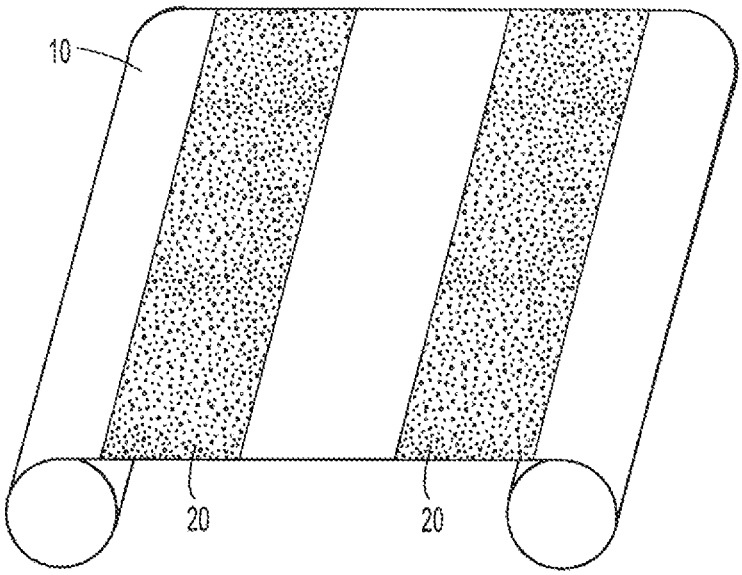
FIGS. 3A-3B schematically illustrate exemplary cleaning webs according to various embodiments of the present teachings.
Figure 3B:
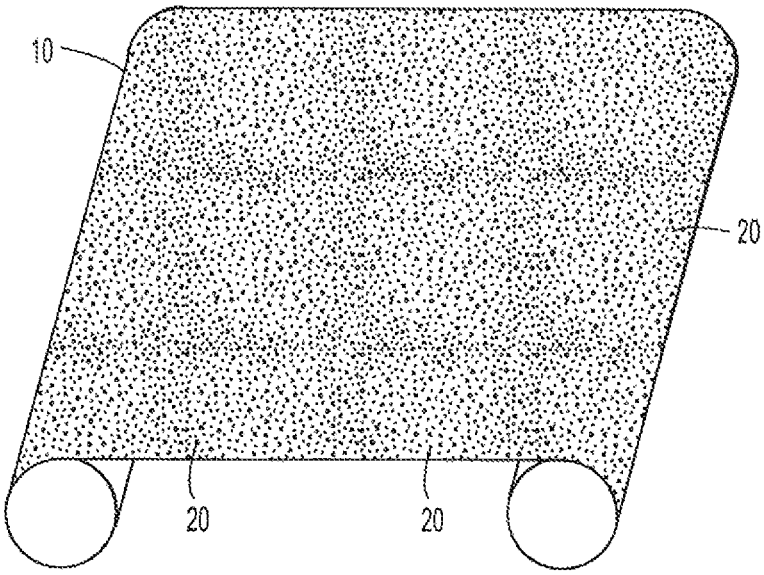

As shown in FIG. 3A, the abrasive 20 can be applied in sections on the non-woven material to form a cleaning web 10 capable of providing periodic cleaning cycles in the fusing apparatus 1. Alternatively, as shown in FIG. 3B, the abrasive 20 can be applied uniformly to the non-woven material so that the abrasive 20 is uniformly distributed over a surface of the cleaning web 10 to provide continuous cleaning in the fusing apparatus 1. In embodiments, the abrasive 20 can be present on a surface of the abrasive cleaning web in an amount ranging from about 1% to about 50%, for example from about 5% to about 30%, such as from about 10% to about 20%.

The abrasive cleaning web 10 is supplied from the supply roll 15 and moves to the take-up roll 14 for collection after use. The supply roll 15 is configured to advance the abrasive cleaning web 10 at regular intervals to provide renewed abrasive surfaces and promote enhanced contaminant removal from the fuser member 2 and/or X-roll 9 surfaces. The take-up roll 14 is configured to collect the used portion of the abrasive cleaning web 10 to be later re-used or replaced. In this way, fresh abrasive 20 is exposed as the abrasive cleaning web 10 is advanced, so effectiveness is not lost over time. In embodiments, the exposed abrasive surface of the abrasive cleaning web 10 is configured to operatively contact the fuser member 2 and/or the X-rolls 9 at regular intervals to "scrub" the fuser and X-roll surfaces and remove contamination.

By using the disclosed cleaning web 10, an additional cleaning station as used in some prior art need not be installed in the fusing apparatus 1. Since space is always a serious consideration in xerographic systems, avoiding the necessity of an extra cleaning station is important. Also, using the cleaning web 10 to remove contamination from the X-rolls 9 and fuser member 2 advantageously avoids the necessity of removing the fuser member 2 for external cleaning and lengthens the lifetime utility of the X-rolls 9 and the fuser member 2. The disclosed cleaning web 10 can prevent contamination of fuser members, external heating rolls, and other fusing apparatus members.

While the disclosure has been illustrated respect to one or more implementations, alterations and/or modifications can be made to the illustrated examples without departing from the spirit and scope of the appended claims. In addition, while a particular feature of the disclosure may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B.

Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A xerographic fusing apparatus comprising:

a fuser member;

at least one external heating member in contact with the fuser member; and a cleaning mechanism for the fuser member, the cleaning mechanism comprising:

an abrasive cleaning web in contact with the at least one external heating member, the abrasive cleaning web comprising a non-woven fabric comprising polyaramid fibers and at least one abrasive, the polyaramid fibers comprising meta-aramid fibers and being present in the non-woven fabric in an amount ranging from about 75 wt. % to about 100 wt. %, the at least one abrasive selected from the group consisting of carbonates, silicates, carbides, clays, and combinations thereof;

a supply roll configured to advance the abrasive cleaning web; and a take-up roll configured to collect the abrasive cleaning web, wherein the xerographic fusing apparatus is configured to transfer the at least one abrasive from the abrasive cleaning web to the at least one external heating member, then to transfer the at least one abrasive from the at least one external heating member to the fuser member, and to remove contamination build-up from the fuser member.

2. The xerographic fusing apparatus of claim 1, wherein the at least one abrasive is selected from the group consisting of carbonates, carbides, silicates, and combinations thereof.

3. The xerographic fusing apparatus of claim 1, wherein the abrasive is present on a surface of the abrasive cleaning web in an amount ranging from about 1% to about 50%.

4. The xerographic fusing apparatus of claim 3, wherein the abrasive is bonded to a surface of the abrasive cleaning web by a binder.

5. The xerographic fusing apparatus of claim 4, wherein the binder is selected from the group consisting of colloidal silica, organic titanates and zirconates, inorganic silicates, polyimides, phenolic resins, silicone resins, silicone containing blends/copolymers, fluoropolymers, and combinations thereof.

6. The xerographic fusing apparatus of claim 1, further comprising a first external heating member and a second external heating member, wherein the abrasive cleaning web contacts the first external heating member and the second external heating member.

7. A xerographic fusing apparatus comprising:

a fuser member;

an external heating member in contact with the fuser member;

a release agent reservoir comprising a release agent;

a meter roll and a donor roll, wherein the meter roll is in contact with the donor roll, the donor roll is in contact with the fuser member, the meter roll is configured to transfer the release agent to the donor roll, and the donor roll is configured to transfer the release agent to the fuser member; and a cleaning mechanism for the fuser member, the cleaning mechanism comprising:

an abrasive cleaning web in contact with the external heating member, the abrasive cleaning web comprising a non-woven fabric comprising polyaramid fibers and at least one abrasive, the polyaramid fibers comprising meta-aramid fibers and being present in the non-woven fabric in an amount ranging from about 75 wt. % to about 100 wt. %, the at least one abrasive selected from the group consisting of carbonates, silicates, carbides, clays, and combinations thereof;

a supply roll configured to advance the abrasive cleaning web; and a take-up roll configured to collect the abrasive cleaning web, wherein the xerographic fusing apparatus is configured to transfer the at least one abrasive from the abrasive cleaning web to the external heating member, then to transfer the at least one abrasive from the external heating member to the fuser member, and to remove contamination build-up from the fuser member.

8. The xerographic fusing apparatus of claim 7, wherein the at least one abrasive is selected from the group consisting of carbonates, carbides, silicates, and combinations thereof.

9. The xerographic fusing apparatus of claim 7, wherein the abrasive is present on a surface of the abrasive cleaning web in an amount ranging from about 1% to about 50%.

10. The xerographic fusing apparatus of claim 9, wherein the abrasive is bonded to a surface of the abrasive cleaning web by a binder.

11. The xerographic fusing apparatus of claim 10, wherein the binder is selected from the group consisting of colloidal silica, organic titanates and zirconates, inorganic silicates, polyimides, phenolic resins, silicone resins, silicone containing blends/copolymers, fluoropolymers, and combinations thereof.

12. The xerographic fusing apparatus of claim 7, wherein the external heating member is a first external heating member and the xerographic fusing apparatus further comprises a second external heating member in contact with the fuser member and the abrasive cleaning web is contacts the second external heating member.

13. A method for cleaning a xerographic fusing apparatus, the method comprising:

contacting an external heating member with an abrasive cleaning web comprising a non-woven fabric comprising polyaramid fibers and at least one abrasive selected from the group consisting of carbonates, silicates, carbides, clays, and combinations thereof, the polyaramid fibers comprising meta-aramid fibers and being present in the non-woven fabric in an amount ranging from about 75 wt. % to about 100 wt. %;

transferring the at least one abrasive from the abrasive cleaning web to the external heating member;

transferring the at least one abrasive from the external heating member to a fuser member; and removing contamination from the fuser member of the xerographic fusing apparatus with the at least one abrasive.

14. The method of claim 13, wherein the external heating member is a first external heating member, and the method further comprises:

transferring the at least one abrasive from the abrasive cleaning web to a second external heating member; and transferring the at least one abrasive from the second external heating member to the fuser member.

15. The method of claim 13, wherein the at least one abrasive is selected from the group consisting of calcium carbonate, silicon carbide, and combinations thereof.

* * * * *